United States Patent [19]

Haastrup

[11] Patent Number: 4,647,757

[45] Date of Patent: Mar. 3, 1987

[54] HAIR DRYER HEATER SECTION PROVIDING UNIFORM OUTLET AIR TEMPERATURE DISTRIBUTION

[75] Inventor: Henrik K. Haastrup, Kalundborg, Denmark

[73] Assignee: Clairol Incorporated, New York, N.Y.

[21] Appl. No.: 728,723

[22] Filed: Apr. 30, 1985

[51] Int. Cl.[4] ..... H05B 3/02; A45D 20/38; F24H 3/04

[52] U.S. Cl. ..... 219/370; 34/97; 132/9; 219/375; 219/532

[58] Field of Search ..... 219/369–371, 219/373–376, 379–381, 532; 132/9; 34/96–101, 243 R

[56] References Cited

U.S. PATENT DOCUMENTS

| | | | |
|---|---|---|---|
| 1,809,458 | 6/1931 | Wahl | 219/364 |
| 2,576,368 | 11/1951 | Steiner | 219/370 X |
| 4,122,329 | 10/1978 | Godel | 219/370 |
| 4,260,875 | 4/1981 | Walter et al. | 219/370 X |
| 4,308,670 | 1/1982 | Bonnema | 219/370 |
| 4,309,595 | 1/1982 | Long et al. | 219/375 X |

FOREIGN PATENT DOCUMENTS

| | | | |
|---|---|---|---|
| 478357 | 6/1929 | Fed. Rep. of Germany | 219/375 |
| 816005 | 10/1951 | Fed. Rep. of Germany . | |
| 2307066 | 8/1974 | Fed. Rep. of Germany . | |
| 2364671 | 6/1975 | Fed. Rep. of Germany . | |
| 2407588 | 8/1975 | Fed. Rep. of Germany . | |
| 2815902 | 10/1979 | Fed. Rep. of Germany . | |
| 2940468 | 4/1981 | Fed. Rep. of Germany . | |
| 981010 | 1/1965 | United Kingdom | 219/370 |
| 1233528 | 5/1971 | United Kingdom . | |
| 1525179 | 9/1978 | United Kingdom . | |
| 2090480 | 7/1982 | United Kingdom | 219/370 |

*Primary Examiner*—Anthony Bartis
*Attorney, Agent, or Firm*—Gene Warzecha

[57] ABSTRACT

A heater section for hair dryers utilizing spirally wound sinusoidally shaped electric resistance heating wire wound about a plurality of radially extending insulating mica boards. The mica boards are axially aligned along the external surface of a central frustoconical/cylindrical motor shroud disposed within a frustoconically shaped dryer housing and are provided with notches to hold the heating wire. A portion of the air moved by the hair dryer fan is blown past the heating wire between the interior surface of the dryer housing and the motor shroud and a portion is blown past the motor between it and the motor shroud. The apertures in the mica boards and the frustoconical/cylindrical motor shroud facilitate the circulation of heated air within the dryer housing. The frustoconical shape of the front portion of the motor shroud adjacent the hair dryer nozzle enhances turbulence within the heater section to facilitate more uniform temperature distribution at the nozzle of the hair dryer.

2 Claims, 6 Drawing Figures

HAIR DRYER HEATER SECTION PROVIDING UNIFORM OUTLET AIR TEMPERATURE DISTRIBUTION

BACKGROUND OF THE INVENTION

1. Field of the Invention

The invention relates generally to hairdrying appliances. More particularly, the invention relates to heater sections used in hair dryers for generating heat.

2. Description of the Prior Art

Hair dryers for drying hair generally comprise a motor for driving a fan to blow air past heated coils of resistance wire. The motor, fan and resistance wire are included in a dryer housing which may be attached to a handle and the hot air is blown out of a nozzle in one end of the housing.

The heater sections of prior art dryers generally comprise resistance wire spirally wrapped about an electrically insulated support frame made of, for example, mica boards and axially interposed in the air stream generated by the fan. One such heater section using coils of wire wrapped around a support board is shown in U.S. Pat. No. 4,260,875 assigned to the assignee hereof. In this type of construction the motor is mounted upstream from the support frame. Another type of heater section comprises a single continuous length of sinusoidally shaped resistance wire (as opposed to a coil) spirally wrapped around a similar frame. In these embodiments the frame consists of a conventional crossed pair of mica boards. The radially distal edges of the mica boards are notched in a saw-tooth pattern to receive the wire which is then connected at predetermined points along its length to a current source. The wire may obviously be connected to the current source at each end to generate the maximum heating ability and various portions of the wire may be connected to a current source by means of taps interposed along the length of the wire.

Another type of known heater section utilizing spirally wound, sinusoidally shaped wire includes a hollow cylinder axially aligned with the air flow and having a plurality of insulating boards radially extending from the external surface of the cylinder with the wire wound around the exposed edges of the insulating boards. In this embodiment the motor is situated within the cylinder with the motor output shaft and attached fan extending from one end of the cylinder.

Both of the aforementioned types of heater sections are inefficient in the distribution of heat at the nozzle output of the hair dryer. Because the resistance wire is essentially concentrically wound about the axis of the hair dryer near the interior of the housing, the air coming out of the nozzle is relatively cool along the axis and extremely hot near the edge of the nozzle. This type of unbalanced temperature distribution occurs in conventional coiled resistance wire heaters as well as those utilizing sinusoidally shaped wire wound about a cylindrical core.

The extremely high tenperatures near the edges of the nozzle create an obvious safety hazard. Such an uneven temperature distribution also necessitates careful selection of the material of the nozzle to enable it to sufficiently withstand such extreme temperatures (on the order of 250° C.). Moreover, such an inefficient temperature distribution necessitiates operating the resistance wire at an unacceptably high level of current in order to produce an acceptable overall temperature output from the hair dryer. This necessarily shortens the life of the heater section.

While the aforementioned U.S. Pat. No. 4,260,875 discloses the use of apertures in the mica boards in order to enhance air circulation within the dryer housing, this air circulation is helpful to more uniformly distribute temperature at the nozzle output, but nevertheless insufficient to efficiently distribute output temperature.

Consequently, it is an object of this invention to provide a heater secton capable of outputting an air flow having a more uniform temperature distribution. Also, it is another object to provide a heater section capable of generating sufficient amounts of heat at lower average operating currents and temperatures of resistance wire.

SUMMARY OF THE INVENTION

The aforementioned objects are accomplished by a heater section constructed in accordance with the principles of the present invention which comprises a spirally wound sinusoidally shaped resistance wire, wound about an axially aligned frustoconical/cylindrical motor shroud provided with perforated insulating boards radially extending from its external surface. The motor shroud has a cylindrical portion which is provided with internal, radially extending ribs for receiving the fan motor, the ribs producing a space between the internal surface of the shroud and the motor housing for enabling cooling air to blow past the motor as the main air stream is blown past the resistance wire. The downstream end of the cylindrical portion of the motor shroud is provided with a frustoconical extension for enhancing turbulance within the heater section to facilitate heat distribution at the nozzle opening. The perforations in the individual insulating boards enable circulatin of the heated air spirally about the motor shroud thereby also facilitating heat distribution.

DESCRIPTION OF THE PREFERRED EMBODIMENT

Figure 1:
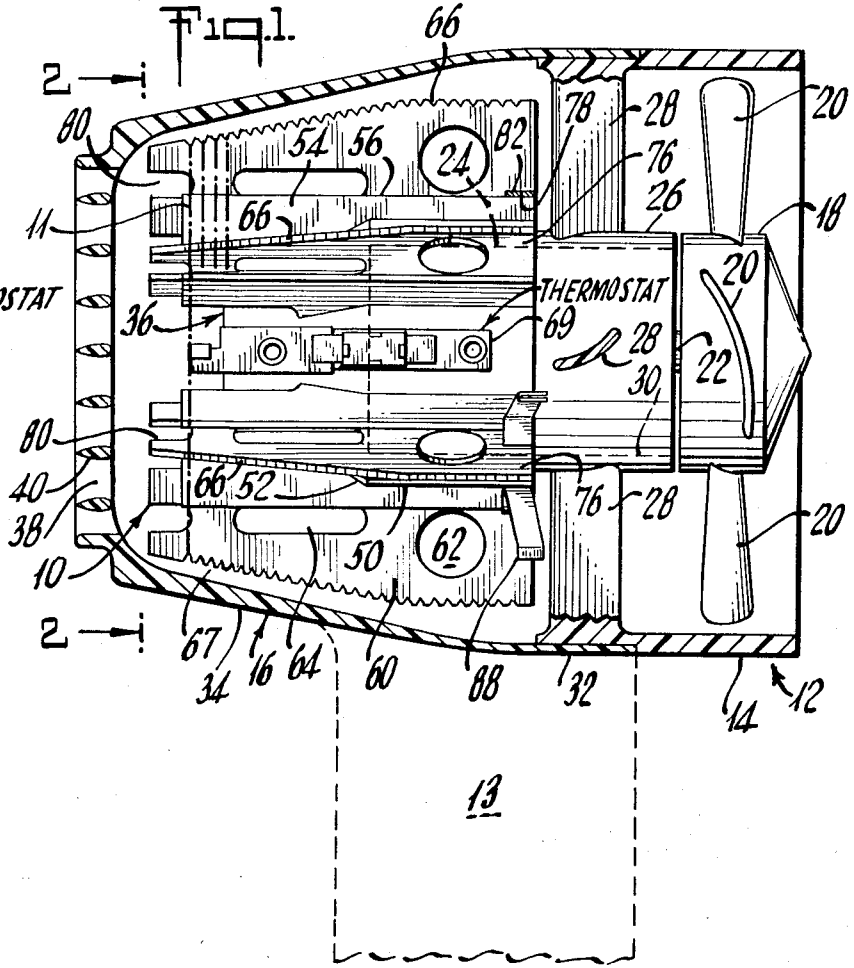
FIG. 1 is a cut away side elevational view of a heater section constructed in accordance with the principles of this invention shown adjacent a fan and dryer housing. The resistance wire is only partially shown for clarity.

Referring now to FIG. 1 there is shown a heater section 10 constructed in accordance with the principles of this invention. Heater section 10 includes sinusoidally shaped resistance wire 11 and is shown in proper relationship within a hair dryer 12 having a handle 13, base portion 14 and nozzle shroud or housing 16. It will be understood that dryer 12 may be either battery operated or provided with a cord (not shown)

for connection to a source of electrical power. Handle 13 may be provided with conventional on/off, fan speed and heat level switches (not shown). Base portion 14 comprises of a conventional fan assembly 18 which has a plurality of fan blades 20 and is secured to output shaft 22 of motor 24 (shown in phantom). A fixed vane assembly 26 which has a plurality of vanes 28 secured to base portion 14 is situated downstream of fan 18. Vane assembly 26 has an axially aligned bore 30 for receiving and holding motor 24 therein.

Nozzle portion 16 has a cylindrical portion 32 integrally formed with a frustoconical portion 34. The internal surface of portions 32 and 34 generally follow the contour of the resistance wire support frame 36. Nozzle portion 16 has a nozzle opening 38 having a grill 40 integrally formed into nozzle portion 16. As will be understood below, the ability of the invention to generate satisfactory output air temperature at relatively low current levels enables the resistance wire to operate at lower temperatures therefore enabling use of nozzle portion 16 without a protective internal sleeve which is generally required in prior art dryers.

Heater section 10 comprises hollow support frame 36 which has a cylindrical portion 50 and a frustoconical portion 52 axially aligned and secured to the downstream end of portion 50. The relationship of frame 36 to the other portions of dryer 12 is best seen in FIG. 1. It will be noted that heater section 10 is aligned adjacent to base portion 14, downstream of fan 18. Motor 24, as stated above, is held within bore 30 and extends axially from base portion 14 into the interior of support frame 36.

Figure 2:
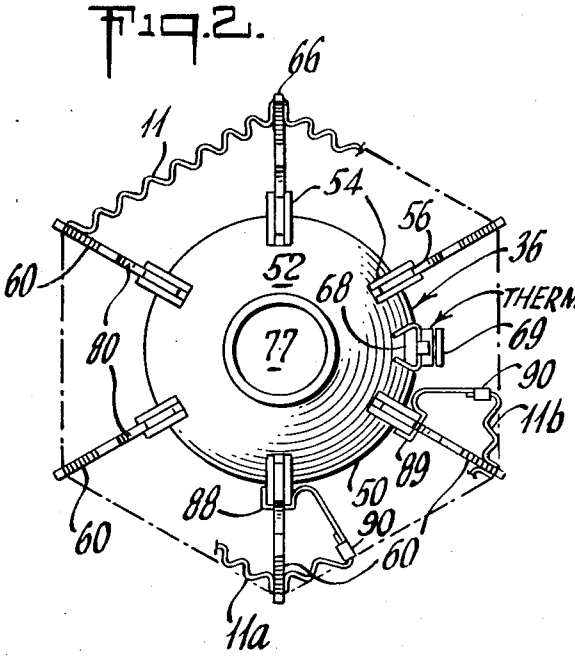
FIG. 2 is a front view of FIG. 1 taken along line 2—2 wherein the dryer housing and all but a portion of the first loop of resistance wire have been omitted for clarity.

Support frame 36 is best seen by reference to FIGS. 2 and 3–5. In the preferred embodiment support frame 36 is made in a one-piece molded configuration of a suitable high-temperature plastic material. The exterior surface of frame 36 is provided with a plurality of radially extending axially aligned ribs 54 each of which is provided with a longitudinal radially outwardly facing groove 56. Each groove 56 is for receiving the end of insulating mica board 60, each board being provided with apertures 62 and 64 and having a predetermined number of notches 66 along the radially distal edge of each board. As will be best seen in FIG. 2, the sinusoidally shaped resistance wire is wound about the radially distal edges of all the insulating boards and the notches 66 serve to retain the wire in position. (Note that, for clarity, the spirally wound wire is only partially shown in FIG. 1 and is shown in FIG. 2 only along a portion of the smallest loop.)

Figure 6:
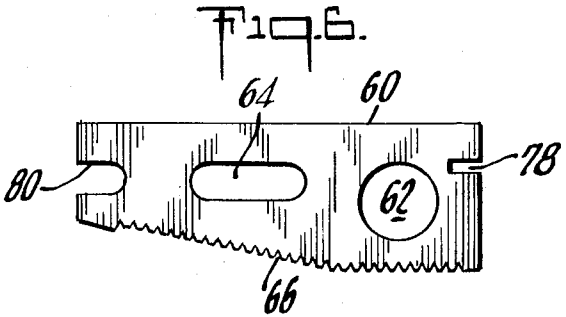
FIG. 6 is an diagrammatic plan view of a single insulating board.

It will be noted that the radially distal edge of each insulating board 60, best seen in FIG. 6, is shaped so that the wire, when wound about all the boards, generally conforms to a segmented cylindrical surface having a segmented frustoconical surface downstream thereof. The size of each insulating board is chosen such that the surface formed by the resistance wire is within a predetermined distance 67 from the nozzle portion 16.

Figure 3:
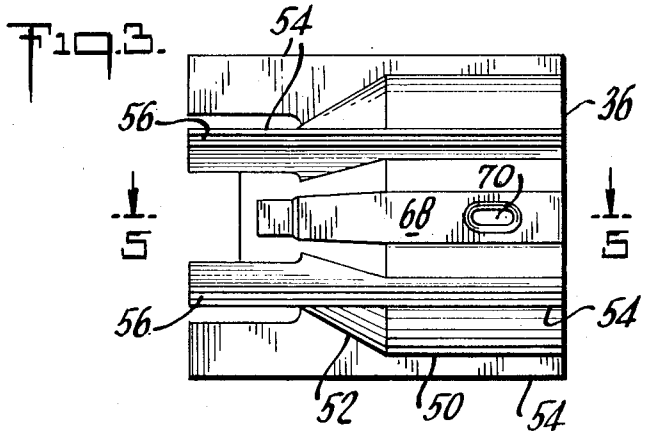
FIG. 3 is a side elevational view of a portion of FIG. 1 showing the frustoconical/cylindrical motor shroud without the insulating boards.

Referring now to FIG. 3 there is shown another side elevational view of support frame 36 showing the individual ribs 54 and a thermostat mounting post 68 axially extending parallel to the ribs 54. As will be appreciated by those skilled in the art from FIGS. 2 and 3 the thermostat mounting post 68 is situated and shaped in such a way (generally a trapezoidal cross-section) as to facilitate mounting thermostate 69 on support frame 36 before or after the wire has been wound on the frame. Aperture 70 enables a wire lead (not shown) to be connected from one end of thermostat 69 (best seen in FIG. 1) to the electrical circuit in a manner well known to those skilled in the art.

Figure 4:
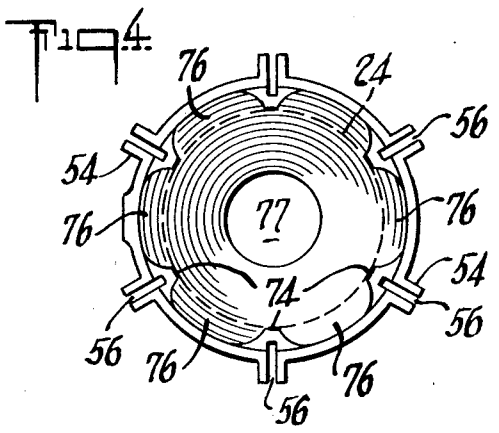
FIG. 4 is a right side elevationed view of FIG. 3 showing the interior of the motor shroud.
Figure 5:
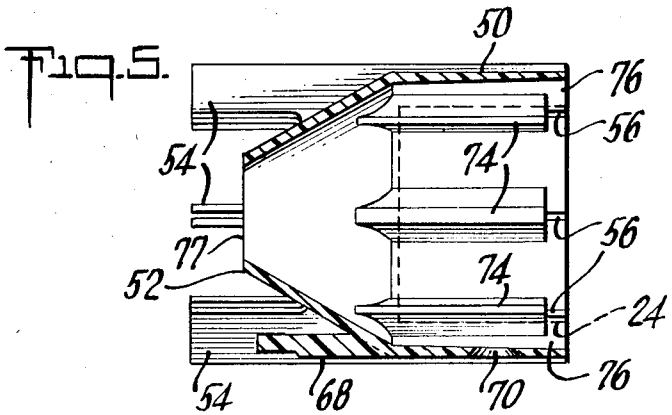
FIG. 5 is a cross sectional view of FIG. 3 taken along line 5—5.

Referring now to FIGS. 4 and 5 it will be noted that the internal surface of support frame 36 is provided with a plurality of radially inwardly extending ribs 74. All of the ribs 74 cooperate to form a compression fit about the external cylindrical housing of motor 26 shown in phantom in FIG. 4 when support frame 36 is placed into its operating position. It will be noted that a plurality of apertures 76 are formed between the internal surface of support frame 36 and motor 26. As will be noted by reference to FIGS. 1 and 5, unheated air blown by fan 18 passes through apertures 76 and out aperture 77 and has a cooling effect on motor 26.

As will be noted from FIG. 6 each of the individual insulating boards 60 includes apertures 62 and 64 as well as a rectanglar cut-out 78 and a substantially hemispherical cut-out 80. Notch 78 is provided to receive a small retaining plate 82 (best seen in FIG. 1) adhesively bonded to the radially distal edge of each rib 54 to hold boards 56 in place. Cut-outs 80 are provided to enhance circulation at the down stream of heater section 10.

For clarity, most electrical connections, wire leads and taps necessary to connect wire 11, motor 26 and thermostat 69 to a source of power have been omitted. In the preferred embodiment shown wire 11 is actually comprised of two parallel wire strands **11*a* and 11*b*, each connected at one end to terminal connections 88 and 89, respectively, via crimped end tabs 90. This parallel construction facilitates variations of heat output from the dryer. Terminal connections 88 and 89 and the other ends of wires 11*a* and 11*b* are connected by means not shown in a conventional manner so as to produce a functional heater. Various taps, also not shown, may be crimped to either wire 11*a* and 11*b*** at predetermined points to also facilitate production of various heat levels.

It will be understood by those skilled in the art that numerous modifications and improvements may be made to the preferred embodiment disclosed herein without departing from the spirit and scope thereof.

What is claimed is:

1. A hair dryer comprising a dryer housing having an air inlet opening and an air outlet opening, an electric motor having a cylindrical housing situated within said dryer housing, a fan driven by said motor, said fan situated adjacent said inlet opening, an electric heating means for heating air blown past said heating means by said fan, means for providing power to said motor and said heating means, said hair dryer characterized in that said motor is surrounded by a heating means support frame downstream of said fan, wherein said support frame comprises:

(a) a cylindrical portion having an inside diameter larger than the diameter of said motor housing, the inner surface of said cylindrical portion provided with a plurality of arcuately spaced longitudinal first ribs extending radially inwardly a predetermined distance, the external surface of said cylindrical portion provided with a plurality of arcuately spaced longitudinal second ribs extending radially outwardly, each of said second ribs provided with a longitudinal groove;

(b) a hollow frustoconical extension aligned at the downstream end of said cylindrical portion, said frustoconical extension having a base diameter substantially the same as said cylindrical portion and a smaller predetermined downstream end diameter;

(c) a plurality of insulating boards each matingly received in a corresponding one of said grooves, each said board extending radially outwardly from said cylinder a predetermined distance and having a plurality of notches on the radially distal edge;

(d) said heating means comprising at least one continuous length of substantially sinusoidally shaped resistance wire wrapped spirally around said boards and engaged in said notches, and (e) electrical connecting means for operatively connecting said wire to a source of power.

2. A hair dryer comprising a dryer housing having an air inlet opening and an air outlet opening, an electric motor situated within said housing, a fan driven by said motor, said dryer housing having a frustoconical shape, a resistance wire heater generally shaped to follow the internal surface of said dryer housing and lying in a substantially segmented frustoconical shape adjacent said internal surface, a central cylindrical sleeve mounted coaxially with said motor and spaced therefrom to enable passage of cooling air past said motor, said sleeve provided with a plurality of arcuately spaced longitudinal, radially extending insulating boards supporting said wire annularly about said sleeve wherein said hair dryer is characterized in that said sleeve is provided with an axially aligned frustoconical extension at the downstream end of said sleeve, said frustoconical extension having an opening at its smallest diameter, distal to said cylindrical sleeve, through which said cooling air is blown, the surface of said frustoconical extension annularly situated intermediate the axis of said sleeve and said resistance wire to enable heated air to circulate about said frustoconical extension, and wherein said hair dryer is further characterized in that said insulating boards are each provided with at least one aperture for enabling air blown by said fan to circulate about said cylindrical sleeve and frustoconical extension.

* * * * *